US012369734B2

(12) United States Patent
Kaisershot

(10) Patent No.: US 12,369,734 B2
(45) Date of Patent: Jul. 29, 2025

(54) BEDDING SYSTEM

(71) Applicant: Marvin Kaisershot, Elko, NV (US)

(72) Inventor: Marvin Kaisershot, Elko, NV (US)

( * ) Notice: Subject to any disclaimer, the term of this patent is extended or adjusted under 35 U.S.C. 154(b) by 124 days.

(21) Appl. No.: 17/686,960

(22) Filed: Mar. 4, 2022

(65) Prior Publication Data

US 2023/0276963 A1 Sep. 7, 2023

(51) Int. Cl.
*A47G 9/04* (2006.01)
*A47C 21/02* (2006.01)
*A47G 9/02* (2006.01)

(52) U.S. Cl.
CPC ..... *A47G 9/04* (2013.01); *A47C 21/022* (2013.01); *A47G 9/0223* (2013.01)

(58) Field of Classification Search
CPC ..... A47C 21/00; A47C 21/02; A47C 21/022; A47C 21/028; A47G 9/02; A47G 9/0207; A47G 9/0223; A47G 9/0261; A47G 9/04; A47G 2009/0269
See application file for complete search history.

(56) References Cited

U.S. PATENT DOCUMENTS 3,874,010 A * 4/1975 Geary ..... A47C 19/045 5/607
5,033,139 A * 7/1991 Renfro ..... A47C 21/022 24/72.5
2010/0154122 A1* 6/2010 Crispino ..... A47G 9/02 5/636
2011/0231994 A1* 9/2011 Avila-Robinson ..... A47C 21/00 5/503.1
2011/0302716 A1* 12/2011 Battaglia ..... A47G 9/02 5/493
2013/0212809 A1* 8/2013 Scarleski ..... A47C 31/105 5/737
2015/0192159 A1* 7/2015 Jaeger-Wayboer .... A47C 19/02 5/304
2015/0305524 A1* 10/2015 Shilts ..... G08B 21/18 5/636
2017/0112292 A1* 4/2017 Sopher ..... A47C 21/028
2017/0332801 A1* 11/2017 Gordon ..... A47C 21/02
2018/0325272 A1* 11/2018 Meisner ..... A47G 9/00
2019/0320807 A1* 10/2019 Backs ..... A47C 21/022
2021/0274943 A1* 9/2021 Adjesson ..... A47C 21/028
2022/0039568 A1* 2/2022 Cordani ..... A47G 9/0253
2022/0167764 A1* 6/2022 Elliott ..... A47G 9/0207
2023/0078278 A1* 3/2023 Russell ..... A47G 9/0261 5/485
2023/0096184 A1* 3/2023 Ogedengbe ..... A47G 9/0207 5/501

* cited by examiner

*Primary Examiner* — George Sun
(74) *Attorney, Agent, or Firm* — Andrew S. Rapacke; The Rapacke Law Group

(57) ABSTRACT

A bedding system may include an integrated top blanket and bottom blanket joined to one another at a seam. A tuck panel may extend from the seam and may include and anchor, the tuck panel and anchor being constructed and arranged to secure the top blanket and bottom blanket to a bed, mattress, box spring, bed frame, or the like.

20 Claims, 3 Drawing Sheets

BEDDING SYSTEM

TECHNICAL FIELD

The embodiments described herein generally relate to blankets, sheets, comforters, and bedding systems.

BACKGROUND

Traditional bedding may include a mattress, supporting box spring, or frame. A mattress sheet may cover the mattress, and a top sheet and blanket may cover individuals in a bed. Top sheets and blankets have a tendency to come untucked from the bedding, become tangled, or slide completely off the bed. Traditional hospital folds or hospital corners provide an inconvenient and temporary means for preventing top sheets and blankets from becoming untucked.

Additionally, persons sharing a bed may often have too little top sheet or blanket for adequately covering both persons. Individuals may prefer their top sheet and blankets to vary in size, length, material, or placement.

BRIEF DESCRIPTION OF THE DRAWINGS

A complete understanding of the present embodiments and the advantages and features thereof will be more readily understood by reference to the following detailed description, appended claims, and accompanying drawings, wherein:

Figure 1:
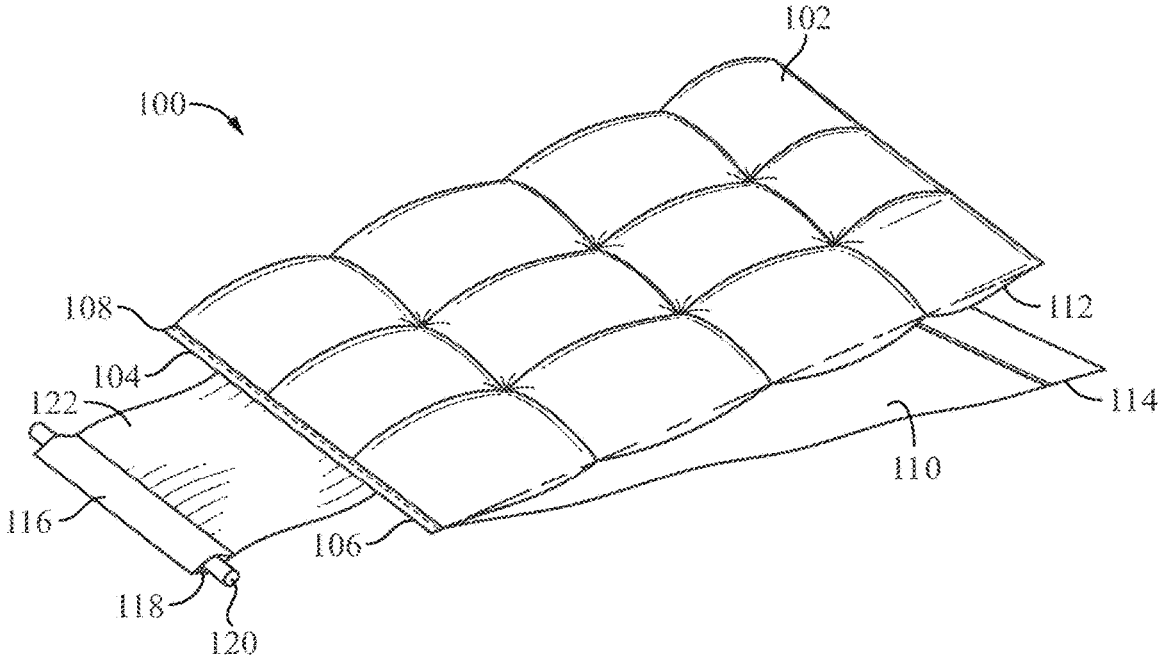
FIG. 1 illustrates a perspective view of one variation of an improved bedding system consistent with this disclosure.

The drawings are not necessarily to scale, and certain features and certain views of the drawings may be shown exaggerated in scale or in schematic in the interest of clarity and conciseness.

DETAILED DESCRIPTION

The specific details of the single embodiment or variety of embodiments described herein are to the described apparatus. Any specific details of the embodiments are used for demonstration purposes only, and no unnecessary limitations or inferences are to be understood therefrom.

Before describing in detail exemplary embodiments, it is noted that the embodiments reside primarily in combinations of components and procedures related to the apparatus. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

The specific details of the single embodiment or variety of embodiments described herein are set forth in this application. Any specific details of the embodiments are used for demonstration purposes only, and no unnecessary limitation or inferences are to be understood therefrom. Furthermore, as used herein, relational terms, such as "first" and "second," "top" and "bottom," and the like, may be used solely to distinguish one entity or element from another entity or element without necessarily requiring or implying any physical or logical relationship, or order between such entities or elements.

As used herein, the term "blanket" and variations of that term may include sheets, comforters, covers, bedspreads, coverlets, duvets, elder down, quilts, or any other bedding.

An improved bedding system may include a top sheet and blanket connected by at least one shared seam. The top sheet and blanket may be attached to one another at the at least one shared seam via a sewn seam, adhesive, or the like. At least one tuck panel may extend from the shared seam and may be attached to the shared seam via a sewn seam, adhesive, or the like. The at least one tuck panel may be a generally square or rectangular cloth panel extending away from the top sheet and blanket and defining a pocket therein. An anchor may be disposed within the pocket of the tuck panel.

In practice and use, the top sheet and blanket may be positioned atop a bed such as a mattress having a frame or box spring thereunder. The anchor may be positioned within the pocket of the tuck panel. The tuck panel and may be folded at least partially under the mattress and positioned between the mattress and frame or box spring such that the anchor and at least a portion of the top panel are secured. The weight of at least the mattress may provide compressive force on the tuck panel and anchor thereby securing the top sheet and blanket on top of the bedding. According to some embodiments, at least a portion of the top sheet and blanket may also be positioned between the mattress and the box spring or frame. The improved bedding system may function to prevent untucking of the top sheet and blanket from underneath the mattress. Additionally, the improved bedding system may function to prevent the need to dress a bed using hospital corners or hospital folds which create inconvenient and time-consuming steps to properly prepare bedding.

According to some embodiments, the top sheet and blanket may be attached at the sewn seam and may further include a second sewn seam along at least one lengthwise side of each of the top sheet and the blanket. This arrangement may allow for individuals sharing a bed to have separate improved bedding systems which may both independently be secured to a bed.

The anchor may be a rod, shaft, plate, disk, block, or plurality of rods, shafts, plates, discs, or blocks. The anchor may be removably disposed within the pocket of the tuck panel such that the top sheet, blanket, and tuck panel may be easily laundered. According to some embodiments, the anchor may comprise wood, metal, plastic, polyvinyl chloride (PVC), or the like.

The top sheet, blanket, and tuck panel may be made of any suitable material commonly associated with bedding such as, but not limited to, cotton, polyester, wool, flannel, jersey, down, or the like.

The improved bedding system may be of varying sizes, shapes, and arrangements suitable for covering a variety of bed or mattress sizes such as, but not limited to, twin, full, queen, king, California king, and the like.

Referring to FIG. 1, an improved bedding system 100 may include a top sheet 110 and a blanket 102. The top sheet 110 may include a first edge 104 and a second edge 114. The blanket 102 may include a third edge 106 and fourth edge 112. The first edge 104 and third edge 106 may be affixed to one another at a first seam 108. The first seam 108 may join the first edge 104 and third edge 106 via a sewn seam, adhesive, mechanical connection, or the like. A tuck panel 122 may also be affixed to the first seam 108 via a sewn seam, adhesive, mechanical connection, or the like. The tuck panel 122 may include a pocket 116 defining a cavity 118 constructed and arranged to hold an anchor 120 therein.

Figure 2:
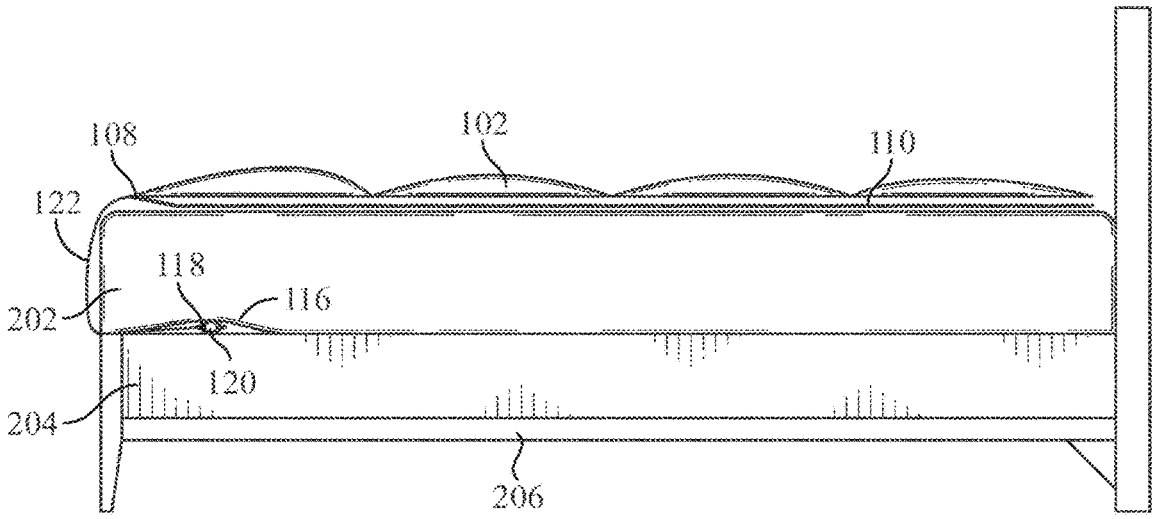
FIG. 2 illustrates a cross-sectional side view of one variation of an improved bedding system consistent with this disclosure.

Referring to FIG. 2, an improved bedding system may include a top sheet 110 and a blanket 102. The top sheet 110 and the blanket 102 may be affixed to one another at a first seam 108. A tuck panel 122 may also be affixed to the first seam 108 via a sewn seam, adhesive, mechanical connection, or the like. The tuck panel 122 may include a pocket 116 defining a cavity 118 constructed and arranged to receive an anchor 120 therein. In practice and in use, the tuck panel 122 and anchor 120 may be disposed between a mattress 202 and box spring 204 or bed frame 206 to prevent untucking of the top sheet and blanket from underneath the mattress.

Figure 3:
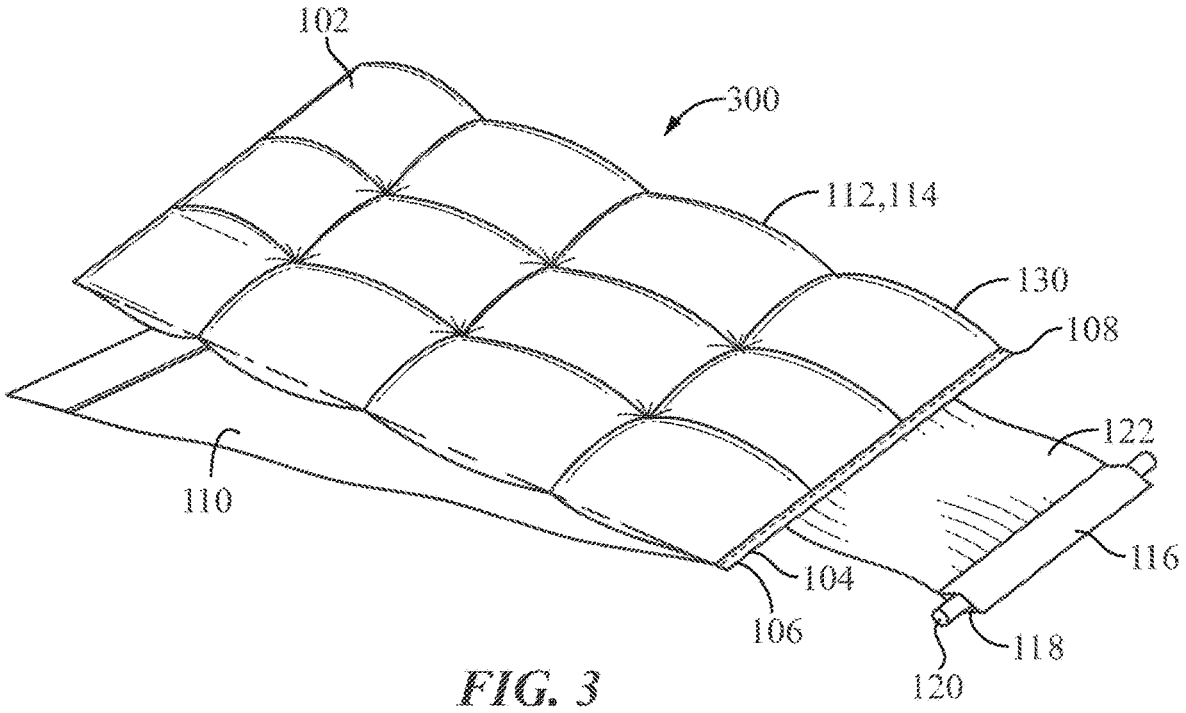
FIG. 3 illustrates a perspective view of one variation of an improved bedding system consistent with this disclosure.

Referring to FIG. 3, an improved bedding system 300 may include a top sheet 110 and a blanket 102. The top sheet 110 may include a first edge 104 and a second edge 114. The blanket 102 may include a third edge 106 and fourth edge 112. The first edge 104 and third edge 106 may be affixed to one another at a first seam 108. The second edge 114 and the fourth edge 112 may be affixed to one another at a second seam 130. The first seam 108 may join the first edge 104 and third edge 106 via a sewn seam, adhesive, mechanical connection, or the like. A tuck panel 122 may also be affixed to the first seam 108 via a sewn seam, adhesive, mechanical connection, or the like. The tuck panel 122 may include a pocket 116 defining a cavity 118 constructed and arranged to receive an anchor 120 therein.

Figure 4:
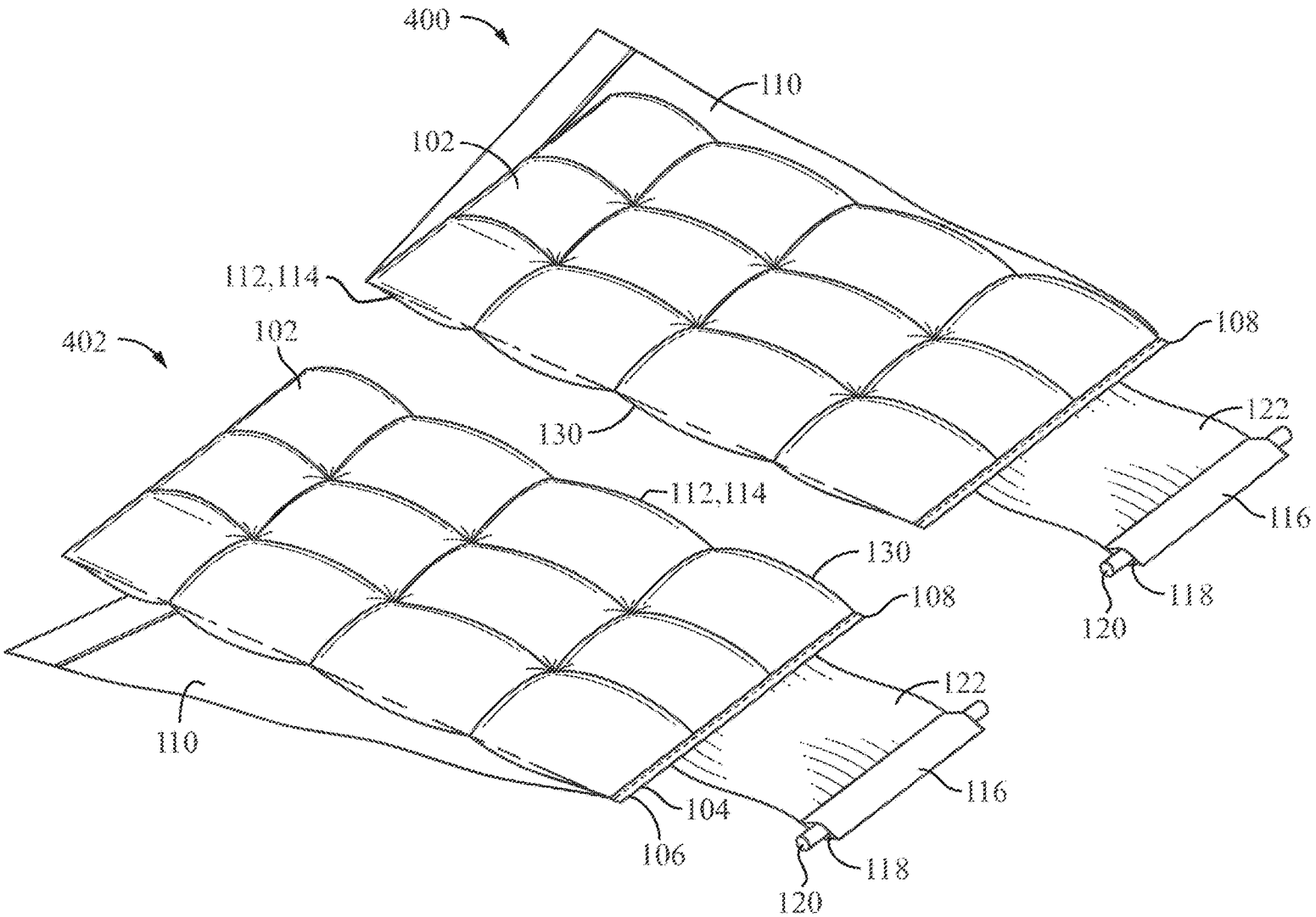
FIG. 4 illustrates a perspective view of one variation of an improved bedding system consistent with this disclosure.

Referring to FIG. 4, an improved bedding system may include a plurality of bedding systems assemblies 400, 402. Each bedding system may include a top sheet 110 and a blanket 102. The top sheet 110 may include a first edge 104 and a second edge 114. The blanket 102 may include a third edge 106 and fourth edge 112. The first edge 104 and third edge 106 may be affixed to one another at a first seam 108. The second edge 114 and the fourth edge 112 may be affixed to one another at a second seam 130. The first seam 108 may join the first edge 104 and third edge 106 via a sewn seam, adhesive, mechanical connection, or the like. A tuck panel 122 may also be affixed to the first seam 108 via a sewn seam, adhesive, mechanical connection, or the like. The tuck panel 122 may include a pocket 116 defining a cavity 118 constructed and arranged to receive an anchor 120 therein. This arrangement may allow for individuals sharing a bed to have separate improved bedding systems which may both independently be secured to a bed.

The following description of variants is only illustrative of components, elements, acts, products, and methods considered to be within the scope of the invention and are not in any way intended to limit such scope by what is specifically disclosed or not expressly set forth. The components, elements, acts, products, and methods as described herein may be combined and rearranged other than as expressly described herein and are still considered to be within the scope of the invention.

According to variation 1, an improved bedding system may include at least one first blanket having at least one first edge; at least one second blanket having at least one second edge; at least one seam attaching the at least one first edge and the at least one second edge; at least one tuck panel attached to the at least one seam, the at least one tuck panel defining at least one anchor pocket defining a cavity; and at least one anchor disposed in the cavity defined by the at least one anchor pocket.

Variation 2 may include an improved bedding system as in variation 1, further including at least one second seam attaching the at least one first blanket and the at least one second blanket.

Variation 3 may include an improved bedding system as in any of variations 1 through 2, wherein the anchor is at least one of a rod, shaft, plate, disk, or block.

Variation 4 may include an improved bedding system as in any of variations 1 through 3, wherein the anchor is a plurality of at least one of rods, shafts, plates, discs, or blocks.

Variation 5 may include an improved bedding system as in any of variations 1 through 4, wherein the anchor includes PVC.

Variation 6 may include an improved bedding system as in any of variations 1 through 5, wherein the at least one first blanket is a comforter.

Variation 7 may include an improved bedding system as in any of variations 1 through 6, wherein the at least one second blanket is a top sheet.

Variation 8 may include an improved bedding system as in any of variations 1 through 7, wherein the improved bedding system is constructed and arranged to secure the at least one first blanket and the at least one second blanket to a bed.

Variation 9 may include an improved bedding system as in any of variations 1 through 8, wherein the at least one seam is a sewn seam.

Variation 10 may include an improved bedding system as in any of variations 1 through 9, further including at least one second seam joining the at least one first blanket and the at least one second blanket.

According to variation 11, an improved bedding system may include a first blanket having a first, second, third, and fourth edge; a second blanket having a fifth, sixth, seventh, and eighth edge; a first seam constructed and arranged to join the first edge and the fifth edge; at least one tuck panel attached to the first seam, the at least one tuck panel extending from the first blanket and the second blanket and including at least one anchor pocket defining a cavity; and at least one anchor removably disposed in the cavity defined by the at least one anchor pocket.

Variation 12 may include an improved bedding system as in variation 11, further including a second seam attaching at least one of the second edge and sixth edge, third edge and seventh edge, or fourth edge and eighth edge.

Variation 13 may include an improved bedding system as in any of variations 11 through 12, wherein the anchor is at least one of a rod, shaft, tube, plate, disk, or block.

Variation 14 may include an improved bedding system as in any of variations 11 through 13, wherein the anchor is a plurality of at least one of rods, shafts, tubes, plates, discs, or blocks.

Variation 15 may include an improved bedding system as in any of variations 11 through 14, wherein the anchor includes PVC.

Variation 16 may include an improved bedding system as in any of variations 11 through 15, wherein the first blanket is a comforter.

Variation 17 may include an improved bedding system as in any of variations 11 through 16, wherein the second blanket is a top sheet.

Variation 18 may include an improved bedding system as in any of variations 11 through 17, wherein the improved bedding system is constructed and arranged to secure the first blanket and the second blanket to a bed, the at least one anchor and at least one tuck panel being positionable beneath at least a portion of a mattress.

Variation 19 may include an improved bedding system as in any of variations 11 through 18, wherein the at least one seam is a sewn seam.

According to variation 20, an improved bedding system may include a first blanket having a first, second, third, and fourth edge; a second blanket having a fifth, sixth, seventh, and eighth edge; a first sewn seam constructed and arranged to join the first edge and the fifth edge; a tuck panel attached to the first seam, the tuck panel extending from the first blanket and the second blanket and including an anchor pocket defining a cavity; a tube anchor removably disposed in the cavity defined by the anchor pocket; and wherein the improved bedding system is constructed and arranged to secure the first blanket and the second blanket to a bed, the tube anchor and the tuck panel being positionable beneath at least a portion of a mattress.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. An improved bedding system comprising:

at least one first blanket having at least one first edge;

at least one second blanket comprising a plurality of edges; at least one seam attaching the at least one first edge and the at least one of the plurality of edges;

at least one tuck panel attached to the at least one seam, the at least one tuck panel defining at least one anchor pocket defining a cavity; and at least one anchor disposed in the cavity defined by the at least one anchor pocket, wherein the at least one anchor is connected to the at least one tuck panel attached to the at least one seam such that the at least one first blanket and the at least one second blanket form a clamshell assembly such that the first blanker and second blanket are prevented from untucking from underneath the mattress.

2. The improved bedding system as in claim 1, further comprising at least one second seam attaching the at least one first blanket and the at least one second blanket.

3. The improved bedding system as in claim 1, wherein the anchor is at least one of a rod, shaft, plate, disk, or block.

4. The improved bedding system as in claim 1, wherein the anchor is a plurality of at least one of rods, shafts, plates, discs, or blocks.

5. The improved bedding system as in claim 1, wherein the anchor comprises PVC.

6. The improved bedding system as in claim 1, wherein the at least one first blanket is a comforter.

7. The improved bedding system as in claim 1, wherein the at least one second blanket is a top sheet.

8. The improved bedding system as in claim 1, wherein the improved bedding system is constructed and arranged to secure the at least one first blanket and the at least one second blanket to a bed.

9. The improved bedding system as in claim 1, wherein the at least one seam is a sewn seam.

10. The improved bedding system as in claim 1, further comprising at least one second seam joining the at least one first blanket and the at least one second blanket.

11. An improved bedding system comprising:

a first blanket having a first, second, third, and fourth edge;

a second blanket having a fifth, sixth, seventh, and eighth edge;

a first seam constructed and arranged to join the first edge and the fifth edge;

at least one tuck panel attached to the first seam, the at least one tuck panel extending from the first blanket and the second blanket and comprising at least one anchor pocket defining a cavity; and at least one anchor removably disposed in the cavity defined by the at least one anchor pocket, wherein the at least one anchor is connected to the at least one tuck panel attached to the at least one seam such that the at least one first blanket and the at least one second blanket form a clamshell assembly such that the first blanker and second blanket are prevented from untucking from underneath the mattress.

12. The improved bedding system as in claim 11, further comprising a second seam attaching at least one of the second edge and sixth edge, third edge and seventh edge, or fourth edge and eighth edge.

13. The improved bedding system as in claim 11, wherein the anchor is at least one of a rod, shaft, tube, plate, disk, or block.

14. The improved bedding system as in claim 11, wherein the anchor is a plurality of at least one of rods, shafts, tubes, plates, discs, or blocks.

15. The improved bedding system as in claim 11, wherein the anchor comprises PVC.

16. The improved bedding system as in claim 11, wherein the first blanket is a comforter.

17. The improved bedding system as in claim 11, wherein the second blanket is a top sheet.

18. The improved bedding system as in claim 11, wherein the improved bedding system is constructed and arranged to secure the first blanket and the second blanket to a bed, the at least one anchor and at least one tuck panel being positionable beneath at least a portion of a mattress.

19. The improved bedding system as in claim 11, wherein the at least one seam 1*s* a sewn seam.

20. An improved bedding system comprising:

a first blanket having a first, second, third, and fourth edge;

a second blanket having a fifth, sixth, seventh, and eighth edge;

a first sewn seam constructed and arranged to join the first edge and the fifth edge;

a tuck panel attached to the first sewn seam, the tuck panel extending from the first blanket and the second blanket and comprising an anchor pocket defining a cavity;

a tube anchor removably disposed in the cavity defined by the anchor pocket, wherein the tube anchor is connected to the tuck panel attached to the first sewn seam such that the first blanket and the second blanket form a clamshell assembly; and wherein the improved bedding system is constructed and arranged to secure the first blanket and the second blanket to a bed, the tube anchor and the tuck panel being positionable beneath at least a portion of a mattress to prevent untucking of the first blanker and second blanket from underneath the mattress.

* * * * *